United States Patent [19]

Kapitanov et al.

[11] Patent Number: 4,460,516

[45] Date of Patent: Jul. 17, 1984

[54] DEVICE FOR MAGNETIZING THE FUEL MIXTURE OF AN INTERNAL COMBUSTION ENGINE

[76] Inventors: Boris A. Kapitanov, Kutuzovsky prospekt, 23, kv. 89; Valery G. Blatov, ulitsa Oxkaya, 24/1, korpus 2, kv. 55; Viktor P. Dmitriev, Kutuzovsky prospekt, 43, kv. 189; Gumer K. Enikeev, ulitsa Novatorov, 14, korpus 2, kv. 193; Mikhail A. Ermilov, Lazovsky pereulok, 4, kv. 95; Anatoly I. Soldatov, Kutuzovsky prospekt, 43, kv. 124; Vladimir N. Cheretaev, ulitsa Astradamskaya, 15-a, kv. 29, all of Moscow, U.S.S.R.

[21] Appl. No.: 403,511

[22] PCT Filed: Nov. 28, 1980

[86] PCT No.: PCT/SU80/00184

§ 371 Date: Jul. 12, 1982

§ 102(e) Date: Jul. 12, 1982

[87] PCT Pub. No.: WO82/01918

PCT Pub. Date: Jun. 10, 1982

[51] Int. Cl.[3] ..... F02M 27/04

[52] U.S. Cl. ..... 261/1; 123/537; 261/DIG. 80

[58] Field of Search ..... 123/536–539; 261/DIG. 80, 1; 210/222

[56] References Cited

U.S. PATENT DOCUMENTS

| | | | |
|---|---|---|---|
| 3,059,910 | 10/1962 | Moriya . | |
| 3,060,339 | 10/1960 | Moriya . | |
| 3,110,294 | 11/1963 | Nyman | 123/536 |
| 3,116,726 | 1/1964 | Kwartz . | |
| 3,228,878 | 1/1966 | Moody | 210/222 |
| 3,349,354 | 10/1967 | Miyata . | |
| 3,767,545 | 10/1973 | Lucero | 210/222 |
| 3,805,492 | 4/1974 | King . | |
| 3,830,621 | 8/1974 | Miller . | |
| 3,889,017 | 6/1975 | Kranz et al. . | |
| 3,893,437 | 7/1975 | Ries et al. . | |
| 3,963,408 | 6/1976 | Youngberg | 123/536 |
| 4,028,998 | 3/1978 | Oder et al. | 210/222 |
| 4,085,717 | 4/1978 | Willmann et al. | 123/538 |
| 4,121,543 | 10/1978 | Hicks, Jr. et al. | 123/537 |
| 4,183,337 | 1/1980 | Marouka | 123/537 |
| 4,183,339 | 1/1980 | Nagaishi et al. | 261/DIG. 80 |
| 4,347,825 | 9/1982 | Suzuki et al. | 123/537 |

FOREIGN PATENT DOCUMENTS

| | | | |
|---|---|---|---|
| 2231424 | 1/1974 | Fed. Rep. of Germany . | |
| 2181852 | 12/1973 | France . | |
| 2376951 | 4/1978 | France . | |
| 580754 | 10/1976 | Switzerland | 261/DIG. 80 |
| 814269 | 6/1959 | United Kingdom | 123/536 |
| 1304827 | 1/1973 | United Kingdom . | |

*Primary Examiner*—Tim R. Miles

*Attorney, Agent, or Firm*—Fleit, Jacobson, Cohn & Price

[57] ABSTRACT

A device comprises an annular permanent magnet (1) embracing an engine fuel mixture duct (6). The poles of the magnet (1) are oriented in such a way that the direction of the magnetic field established thereby is parallel to the direction of the fuel mixture flow in the duct (6). The magnet (1) is fitted in a nonmagnetic flat body (2) made from a zinc alloy. If viewed in the direction of the fuel mixture flow, the south pole of the magnet (1) is closer to the engine than the north pole thereof. The inner diameter of the annular magnet (1) is equal to the inner diameter of the fuel mixture duct (6). The magnetic intensity in the center of the annular magnet (1) is within 50–250 oersteds.

5 Claims, 3 Drawing Figures

DEVICE FOR MAGNETIZING THE FUEL MIXTURE OF AN INTERNAL COMBUSTION ENGINE

TECHNICAL FIELD

The invention relates to internal combustion engines, and more specifically, to a device for magnetizing the fuel mixture of an internal combustion engine, the operation whereof involves the combustion of liquid organic fuels (gasoline, kerosene, diesel fuel, petroleum).

BACKGROUND ART

The operation of heat engines and installations is characterized by a relatively low efficiency on the one hand, and environmental contamination, on the other.

The low efficiency of heat engines and installations is conductive to waste of scarce and costly fuels (petroleum and its derivatives), radiation of a considerable amount of heat into the atmosphere and also overheating of working elements of heat engines and installations. Incomplete fuel combustion due to low efficiency is accompanied by exhaust of bottom products of the combustion process, including toxic solid and gaseous components, into the environment. Higher power rating of internal combustion engines and continuous growth of the number thereof calls for new engineering solutions, which would allow the efficiency to be improved, fuel economized and the environmental contamination level cut down.

In recent years a great number of writings in this country and abroad have been devoted to study of the action of the magnetic field on the physical and chemical properties of various substances and the kinetics of interaction thereof, and also to the development of equipment to exert said action of the magnetic field. In particular, mention has been made of a positive effect produced by magnetizing water and aqueous solutions, resulting in a thinner layer of solid deposits on the walls of pipes and thermal pipelines using water as the heat transfer agent, higher strength of concretes mixed with water subjected to magnetic treatment, etc. The magnetic field has also been reported to influence life processes in plant and animal cells, and in living organisms as a whole.

Finally, numerous patents contain proposals on the improvement of operation of thermal plants and heat engines, wherein the magnetic field acts on a fuel, fuel mixture or oxidizer. Some of such patents describe a positive effect being attained through acting on a fuel, fuel mixture or oxidizer by the magnetic field alone, with the magnetic field required for magnetizing being produced either by permanent magnets or by a d.c. or a.c. electromagnet.

The problem of environmental protection is one of the most pressing issues of today's reality. The automobile being a major source of pollution, various proposals have been advanced to reduce the toxicity of exhaust gas components, e.g. the development of new types of engines and carburetors, use of new fuels and different additives thereto, providing fuel afterburner systems, etc.

However, the majority of solutions hitherto proposed have failed to find broad application due to considerably higher cost and more complicated design of the automobile, low efficiency and failure to settle the question of cleaning exhaust gases of the millions of automobiles in operation.

Higher performance charcteristics shown by internal combustion engines with the fuel mixture properly treated are connected with changes in the physical and chemical parameters of the combustion reaction, reagents and the products of the reaction, which is followed by an increase in the fuel mixture ionization level, and also by a higher density, conductivity, kinetic viscosity and surface tension of fuel drops.

Known in the prior art are various devices for the treatment of fuels, fuel mixtures and oxidizers with the aid of the magnetic field. Thus, U.S. Pat. IPC F02M 27/04 No. 3,805,492, British Pat. IPC F02M 27/04, 27/06 No. 1,304,827, FRG Patent IPC 46c 27/04 No. 2,231,424 describe devices used to impart an electric charge to a liquid or gaseous fuel or a fuel mixture. The electrization of the fuel or fuel mixture is effected by providing the devices with systems of special electrodes with a high electric potential applied thereto, or by using dielectric materials to ensure triboelectrification.

Electric treatment of fuels or fuel mixtures changes the physical and chemical properties thereof, thereby affecting the course of the reaction. Electric treatment also lessens surface tension of drops of fuel, thus improving the process of evaporation thereof and formation of the fuel mixture.

Disadvantages of said devices for the treatment of fuels or fuel mixtures with the aid of the electric field consist in their intricacy, low reliability, need for a self-contained high-voltage source and low efficiency.

U.S. patents cl.261-72, U.S. Pat. Nos. 3,059,910, 3,060,339, cl. 431-356 U.S. Pat. No. 3,830,621, cl. 123-119 U.S. Pat. No. 3,116,726, 3,889,017, FRG Patents cl. F02f No. 1,037,765, IPC F02M 27/00 No. 225,679 Swiss Patent cl. F02M 27/04 No. 580,754, French Patent IPC F02M 27/04 No. 2,181,852 propose devices for magnetic treatment of a fuel, fuel mixture or oxidizer, with the magnetic field being set up through the use of permanent magnets or diverse electromagnets. Power to electromagnets is supplied either from an individual source or from the engine ignition system. Power supply source circuits are generally rather sophisticated. The magnetic field is set up in fuel pipelines, float chambers, carburetors, air intakes, air cleaners, cylinder head, cylinder block and other parts of the engine fuel system. Like the electric treatment, the magnetic treatment affects the physical and chemical properties of the fuel or fuel mixture, thereby intensifying the combustion and increasing the fuel burning temperature, and reducing the volume of incomplete combustion products, including toxic components of exhaust gases.

Finally, devices have been proposed, wherein the fuel is acted upon by the electric and magnetic fields simultaneously (cf. U.S. Pat. No. 3,349,354 cl. 335-209). The devices listed above have a number of limiting factors, the main being sophisticated design and process, which inevitably complicates the construction of the entire fuel system of the engine and combustion chambers thereof and of the power supply and ignition systems, thereby decreasing the reliability and increasing the cost thereof, and considerably lengthening the cycle of preliminary treatment of the fuel prior to combustion. Use of said devices failed to yield tangible effects.

Another prior art device (cf. U.S. Pat. No. 3,893,437 cl. 123-119E) to treat a fuel mixture by the electric and magnetic fields simultaneously and also by applying heat thereto is made up of a set of plates fitted under the carburetor. Some of the plates are provided with gauzes for atomizing and mixing the fuel mixture, whereas other plates are fitted with permanent magnets and resistors for heating the upper and the lower gauzes, building up the kinetic energy of hydrocarbon molecules and establishing a magnetic field of force. There are also plates used as the basis for the device and as gaskets. Permanent magnets built in a plate are made in the form of cylinders disposed opposite to each other and establishing a radially directed magnetic field. Power to the resistor installed in one of the plates is supplied from the automobile electric system.

A disadvantage of the device is complicated design and low reliability due to the presence of the resistor and gauzes. Moreover, research has shown that a magnetic field perpendicular to the direction of the fuel mixture flow brings about a reduction of the engine efficiency, and not in an increase thereof.

An object of the present invention is to overcome the above disadvantages.

DISCLOSURE OF THE INVENTION

The essence of the present invention lies in providing a device for magnetizing the fuel mixture of an internal combustion engine, which would set up a magnetic field of the required form and intensity and reduce considerably the content of hydrocarbons, carbon monoxide and other toxic components of exhaust gases, and which does not need a power supply source.

This is accomplished in a device for magnetizing the fuel mixture of an internal combustion engine, comprising a permanent magnetic field source fitted in the engine fuel system, according to the invention, wherein the function of the magnetic field source is discharged by an annular permanent magnet installed in a nonmagnetic body and embracing the engine fuel mixture duct, the magnet poles being oriented in such a way that the direction of the magnetic field set up thereby is parallel to the direction of the fuel mixture flow.

The source of the magnetic field being represented by an annular permanent magnet embracing the engine fuel mixture duct and magnetized along the generatrix in such a manner that the magnetic lines of force are directed along the fuel mixture flow ensures independent operation of the device with no power supply required for the treatment of the fuel mixture. The annular shape of the magnet and coincidence of the direction of the magnetic lines of force with the direction of the fuel mixture flow promotes intensive magnetizing of the fuel mixture due to the fact that such magnets set up a uniform annular magnetic field, wherein all mixture particles passing through the ring are in approximately equal conditions. Besides, the direction of the magnetic lines of force being parallel with the direction of the fuel mixture flow, ionization, polarization, atomization and mixing of the particles are the most intensive. Using an annular permanent magnet as a source of the magnetic field ensures independent operation of the device and obviates the need for external power supply sources.

The proposed device makes it possible to appreciably increase the engine efficiency and reduce fuel consumption and content of toxic components in exhaust gases. Moreover, the design of the proposed device is much simpler than that of the prior art devices.

It is practicable that the nonmagnetic body of the annular permanent magnet is made flat, for such a construction facilitates mating of the device with the engine fuel mixture supply system and allows the available fastening parts to be used and tightness of joints to be easily and reliably ensured by using sealing gaskets.

It is expedient to install the device in such a manner that the south pole of the magnet is the closest to the engine if viewed in the direction of the fuel mixture flow, because such an arrangement of the device contributes to the most complete and properly oriented polarization of the mixture particles, thereby facilitating fuel combustion.

To ensure proper serviceability of the device it is quite indispensable that the magnetic flux is directed inside the annular magnet. To fulfil this condition, the body should be made from a nonmagnetic alloy, because in this case (unlike a ferromagnetic body) the form of the working magnetic field is not distorted and its energy is concentrated in the center of the annular magnet. It is most expedient that the nonmagnetic body be made by chill or die casting, the optimum material for the purpose being a zinc alloy, which fulfils the condition of the body being made from a nonmagnetic material and precludes the formation of cracks in the magnet and the body itself due to the low melting point of the zinc alloy and the coefficient of volumetric expansion thereof being close to that of the material of the magnet.

In the preferred embodiment of the invention an annular permanent magnet has an inner diameter equal to the inner diameter of the fuel duct, which makes the inner surfaces of the magnet and the duct fit each other, thereby offering a free passage to the fuel mixture through the device without increasing the turbulence of the flow and formation of a film of fuel on the walls of the fuel duct.

It is desirable that the magnetic intensity magnitude is within 50–260 oersteds in the center of the annular magnet opening. The optimum value of the magnetic field intensity depends on the engine displacement and the shape of the fuel mixture duct. In the event of the value of the magnetic intensity being lower than the optimum one the magnetizing effect is nonexistent, whereas higher values impair engine operation.

BRIEF DESCRIPTION OF THE DRAWINGS

Other objects and advantages of the present invention will become apparent from the following detailed description of an embodiment thereof taken in conjunction with the accompanying drawings, wherein.

BEST MODE OF CARRYING OUT THE INVENTION

Figure 3:
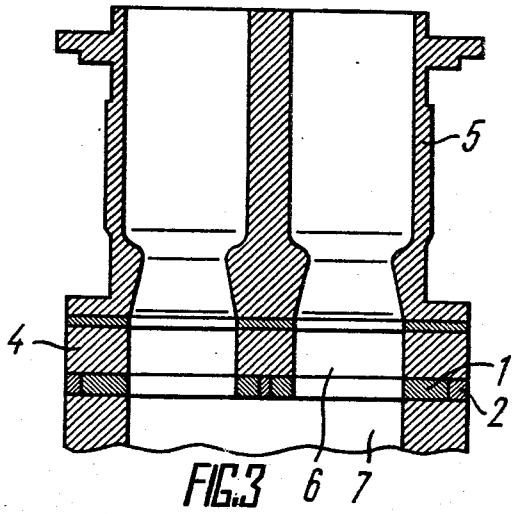
FIG. 3 illustrates a version of mounting the device on the engine intake manifold to admit fuel mixture (longitudinal section).
Figure 1:
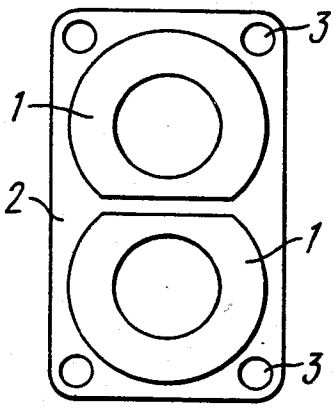
FIG. 1 shows an embodiment of the device, according to the invention (plan view)
Figure 2:
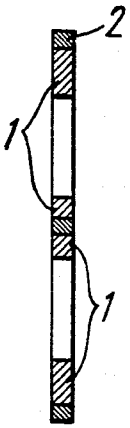
FIG. 2 represents an embodiment of the device (side view)

FIGS. 1, 2 and 3 show a variant of using the device in the fuel mixture supply system of a double-barrel carburetor internal combustion engine.

The device comprises two annular permanent magnets 1 fitted in a flat nonmagnetic body 2 functioning as a gasket. To secure the magnets 1 in the body 2, use may be made of a glue. The body 2 is made from a nonmagnetic material (e.g. zinc alloy) by chill or die casting, with the casting moulds having the form of the body 2. The body 2 has holes 3 aligned with the fastening holes in a flange 4 of a carburetor (FIG. 3). In the embodiment illustrated in FIG. 3 the device for magnetizing the fuel mixture is installed just behind the carburetor 5 of the internal combustion engine. Tightness of fuel ducts 6 is ensured by sealing gaskets (not shown), with the device and the carburetor 5 being secured to an intake manifold 7 by means of standard fastening elements.

The inner diameter of the magnets 1 is equal to the inner diameter of the fuel ducts 6 embraced by the former. The magnets 1 are oriented in such a way that the direction of the magnetic field established thereby coincides with the direction of the fuel mixture flow in the ducts 6, with the south pole of the magnets 1 being the closest to the engine if viewed in the direction of the fuel mixture flow.

Other types of internal combustion engines may use other embodiments of the device and variants of mounting thereof in the fuel mixture system, with variable numbers of both the devices installed and of annular permanent magnets in one device. For instance, when the device is secured under the carburetor the number of devices is determined by the number of carburetors on one internal combustion engine, whereas the number of magnets in the device depends on the number of barrels in each carburetor.

When an internal combustion engine is provided with a distribution intake manifold, devices for magnetizing the fuel mixture are mounted on each fuel mixture duct separately. In the event of a four-stroke internal combustion engine with a valve-type timing gear, for instance, devices may be fitted in the valve seats directly.

The annular permanent magnets 1 are made from high-coercitivity magnetic alloys on the basis of iron (Fe)-nickel (Ni)-cobalt (Co)-aluminium (Al) or ferrites. The annular permanent magnets 1 of the device are magnetized at the last stage of the manufacture thereof till complete saturation, after which the magnets are stabilized so that the magnetic intensity in the center of the magnets 1 is within 50–250 oersteds.

The device for magnetizing the fuel mixture operates as follows. From the carburetor 5 the fuel mixture passes through the inner holes of the annular permanent magnets 1 of the device, becomes magnetized and enters the combustion chamber of the internal combustion engine through the intake manifold 7.

Developing such a device was motivated by a number of reasons. Research has shown that maximum effect is attained by magnetizing not the fuel proper, but the fuel mixtures, with the magnetic treatment being carried out: first, with the aid of a permanent magnetic field of a definite intensity, the direction of the magnetic lines of force whereof coincide with the direction of the fuel mixture flow; second, in an open magnetic system due to the main role being played by the scattering fields; third, with the mixture treatment unit located as close as possible to the combustion chamber of the internal combustion engine, thereby precluding violations of aerodynamic laws of the mixture flow.

As the fuel mixture is treated in the magnetic field of an open magnetic system including the annular permanent magnets 1, fuel and water molecules present in the mixture are magnetized, polarized and oriented in a definite way. As a result, heavy hydrocarbons are split into lighter fractions, noxious admixtures are deactivated and the fuel burns out in a maximum degree. The physicochemical aspect of the process of magnetizing the fuel mixture not being given a unique interpretation, other explanations are not excluded either.

Tests of 1,500-cm$^3$ engines revealed high effectiveness of the magnetic treatment of the fuel mixture. Magnetized with the aid of the proposed device, it acquired new properties, as a result of which the content of carbon monoxide in exhaust gases is reduced by more than 150%, engine efficiency is considerably increased and maximum power is 5–15% higher. Being actually a 3–7 mm thick gasket, the device is very simple in design and highly reliable, as well as lowpriced, which renders it usable in all types of internal combustion engines.

INDUSTRIAL APPLICABILITY

The proposed device is intended mainly for use in automobiles in operation. Due to maximum simplicity of design its mounting does not call for qualified personnel or special engineering preparation; it can be performed by the driver in any conditions. The device may also be fitted at the manufacturing plant, although in this case it is possible and even advisable to arrange annular magnets directly at the base of the carburetor body, in seats of valves of the timing gear and other parts of the fuel system of an internal combustion engine.

The present invention can be used to the best advantage in carburetor and diesel internal combustion engines, gas-turbine and jet engines, and in stationary thermal plants.

We claim:

1. A device for magnetizing the fuel mixture of an internal combustion engine, comprising permanent magnetic field means fitted in the engine fuel system, said magnetic field means being in the form of an annular permanent magnet installed in a nonmagnetic body and positioned in an engine air-fuel mixture duct, said magnet having an inner diameter substantially equal to the inner diameter of the air-fuel mixture duct, the poles of the magnet being oriented in such a way that the direction of the magnetic field established thereby is parallel to the direction of the air-fuel mixture flow in the duct.

2. A device as claimed in claim 1, wherein the nonmagnetic body in which the magnet is installed is made flat to facilitate mating of the device with an engine air-fuel mixture supply system.

3. A device as claimed in claim 1, wherein the magnet is arranged in such a manner that the south pole thereof is the closest to the engine when viewed in the direction of the air-fuel mixture flow.

4. A device as claimed in claim 1 or 2, wherein the nonmagnetic body of the magnet is made from a zinc alloy.

5. A device as claimed in claim 1, wherein the magnetic intensity in the center of the annular magnet is within 50–250 oersteds.

* * * * *